US005377724A

United States Patent [19]

Ray

[11] Patent Number: 5,377,724

[45] Date of Patent: Jan. 3, 1995

[54] AEROSOL CAN FILLER

[76] Inventor: George F. Ray, Green Lane, Chessington; Surrey KT9 2DT, United Kingdom

[21] Appl. No.: 925,856

[22] Filed: Aug. 6, 1992

[51] Int. Cl.[6] ..... B65B 3/00

[52] U.S. Cl. ..... 141/20; 141/86; 141/348

[58] Field of Search ..... 141/2, 3, 18, 20, 21, 141/25-27, 71, 73, 86, 88, 94, 258, 346-349; 222/108

[56] References Cited

U.S. PATENT DOCUMENTS

| | | | |
|---|---|---|---|
| 1,961,563 | 6/1934 | Luckie | 141/86 |
| 3,187,787 | 6/1965 | Kerr | 141/348 |
| 3,444,906 | 5/1969 | Moonan et al. | 141/20 |
| 3,532,139 | 10/1970 | Ruscitti | 141/20 |
| 3,592,244 | 7/1971 | Chamberlin | 141/20 X |
| 3,738,400 | 6/1973 | Weil et al. | 141/73 |
| 3,797,534 | 3/1974 | Skidmore | 141/3 |
| 4,303,108 | 12/1981 | Akers et al. | 141/2 |
| 4,938,260 | 7/1990 | Hirz | 141/20 |

FOREIGN PATENT DOCUMENTS

| | | | |
|---|---|---|---|
| 137908 | 4/1985 | European Pat. Off. . | |
| 0015496 | 11/1897 | Switzerland | 141/349 |
| 1103083 | 2/1968 | United Kingdom . | |
| 1260264 | 1/1972 | United Kingdom . | |

*Primary Examiner*—J. Casimer Jacyna
*Attorney, Agent, or Firm*—Christie, Parker & Hale

[57] ABSTRACT

An aerosol dispenser filling apparatus in which a liquid, such as paint, containing cylinder (24) is removably mounted above an aerosol can receiving position above the cylinder into the cylinder which has an upper flared or expanded extremity (26) to guide the piston into the cylinder. The aerosol can (46) is connected to the bottom of the cylinder so that the liquid is forced from the cylinder into the can.

6 Claims, 3 Drawing Sheets

FIG.2.A
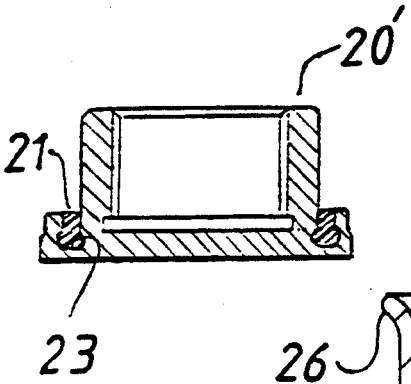
FIG.2.
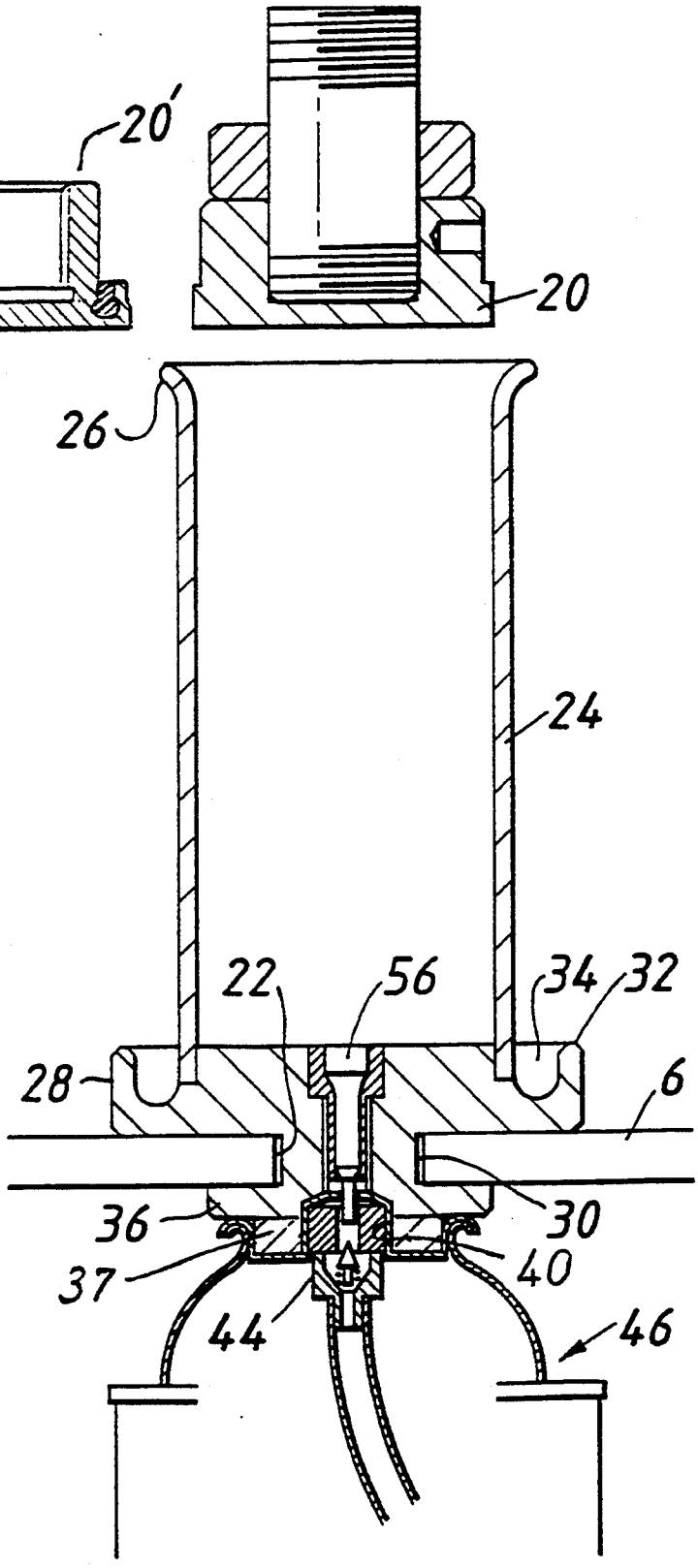

AEROSOL CAN FILLER

The present invention relates to apparatus for filling aerosol dispensers.

A hand operated aerosol dispenser or can filling apparatus is described in GB Patent No. 1,103,083. This apparatus comprises a cylinder into which a liner is placed. The liner has an upper container portion, a central piston receiving portion and a lower aerosol valve receiving portion. The apparatus has a frame with a base for supporting an aerosol can with its protruding valve uppermost and a recessed bracket above the base to receive the cylinder. Pivotally mounted to the frame is an arm having a handle which engages with a piston. The piston is arranged to fit into the liner and cooperate with the central piston receiving portion to pump liquid from the upper container portion through the aerosol can valve into the can. When the can is filled the liner is usually thrown away. The liner is made of translucent plastics so that its content level when in the cylinder can be viewed through a window in the cylinder.

Whilst the above known apparatus is easy to operate and suitable for filling small numbers of cans, when large numbers of cans have to be filled removal and disposal of liners which necessitates removal of the piston and disconnection of the piston from the operating arm is time consuming, can be messy and requires new liners to be constantly available.

A further aerosol can filler is described in GB Patent No. 1260264. This has a power actuated piston which works in a paint receiving cylinder. The piston operates from an upper position which is within the cylinder so that the cylinder is awkward to fit and is normally left in the apparatus after filling a can. This makes it troublesome to clean and furthermore there are problems with ensuring accurate entry of the piston into lower part of the cylinder.

An aerosol dispenser filling apparatus according to the invention comprises a cylinder having a lower aerosol can valve engaging portion, the cylinder being removably mounted to a part of the apparatus above an aerosol can receiving position, a piston mounted in the apparatus and means to actuate the piston for movement within the cylinder to force liquid within the cylinder through a valve of aerosol can mounted to the valve engaging portion wherein the piston is mounted for movement from a position outside and above the cylinder when mounted in the apparatus and in that the cylinder has an upper open mouth having an inner surface opening outwardly to provide an upper extremity of greater diameter than that of the piston so as to provide a gradually decreasing entry for the piston into the cylinder and to guide the piston into the cylinder.

In the apparatus according to the invention the cylinder does not require a liner since the piston engages directly with the cylinder wall and it is a simple operation to fit the can and cylinder together, fill the cylinder which can if required be weighed together to check the cylinder contents. The cylinder and can together are then slid into the apparatus and suitably by means of a powered activator means the piston is lowered into the cylinder to force the liquid contents of the cylinder into the can.

Preferably the valve engaging portion of the cylinder is threaded to engage around a periphery of the aerosol can valve. This enables the can to be locatable off the base of the apparatus to allow for different can sizes to be accommodated within he apparatus. An adjustable base can be provided in the apparatus for seating the cans so that the load is taken from the threaded connection between the cylinder and can valve.

Preferably the cylinder has a recessed portion or circumferential groove at its lower end to engage with a recess in a support part of the apparatus. The cylinder may have a drip receiving circumferential extension above the recessed portion.

In order to obtain a good liquid tight seating between the cylinder and aerosol valve a cylindrical protrusion may be provided in the lower part of the cylinder which is adapted to fit within the outlet aperture of the aerosol valve, the cylindrical protrusion having a central conduit connecting the cylinder to the can.

To prevent the piston entering the cylinder before it is in place an interlock device may be provided in an actuation circuit. In order to prevent spillage or accidents the cylinder and can positions in the apparatus may be enclosed with an entry door. This door may have a further interlock to prevent actuation taking place before the door is closed.

An embodiment of the invention will now be described with reference to the accompanying drawings in which:

FIG. 2 is an enlarged cross sectional view of a part of the apparatus of FIG. 1 showing cylinder, piston and aerosol can head relationship, FIG. 2A is a cross section of a piston of a modified design to that shown in FIG. 2.

Figure 1:
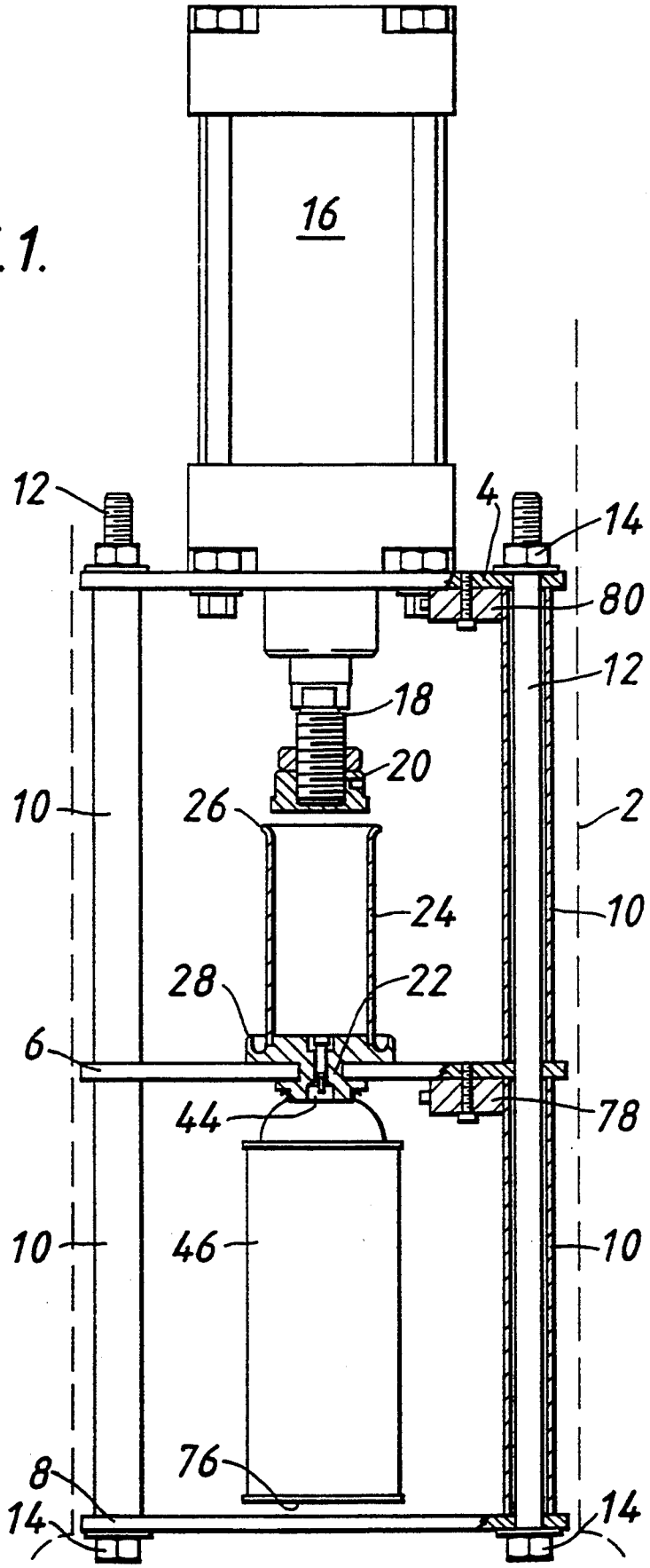
FIG. 1 shows an aerosol dispenser fitting apparatus according to the invention.

In FIG. 1 aerosol dispenser or can filling apparatus is shown having an enclosing casing or cabinet removed but indicated by broken lines 2. The casing has a door (not shown) giving access to the interior below a top plate 4.

The apparatus has a frame formed from top plate 4, a central plate 6 and a base plate 8 held together by spacer tubes 10 and bars 12. The plates are secured by nuts 14 threaded to the bars 12.

Mounted to top plate 4 is a pneumatic actuator motor 16 which drives a piston rod 18 to which is attached a piston 20. This piston is formed of a solid block of a suitable plastics material such as nylon. Alternatively the piston is as shown at 20' in FIG. 2A. In this later construction a groove 23 is formed around the base of the piston which is filled with a resilient material 21 such as moulding rubber. This provides a more resilient engagement with the inner surface of the cylinder.

Below piston 20 a cylinder 24 into which piston 20 can descend is removably mounted in a slot 22 in plate 6. The cylinder 24 has an upper open flared extremity 26 which guides the piston into the cylinder. The cylinder 24 has a base portion 28 which is recessed by providing a circumferential groove 30 (see FIG. 2) and a drip receiving circumferential extension 32 having an upwardly facing drip trough 34.

Figure 3:
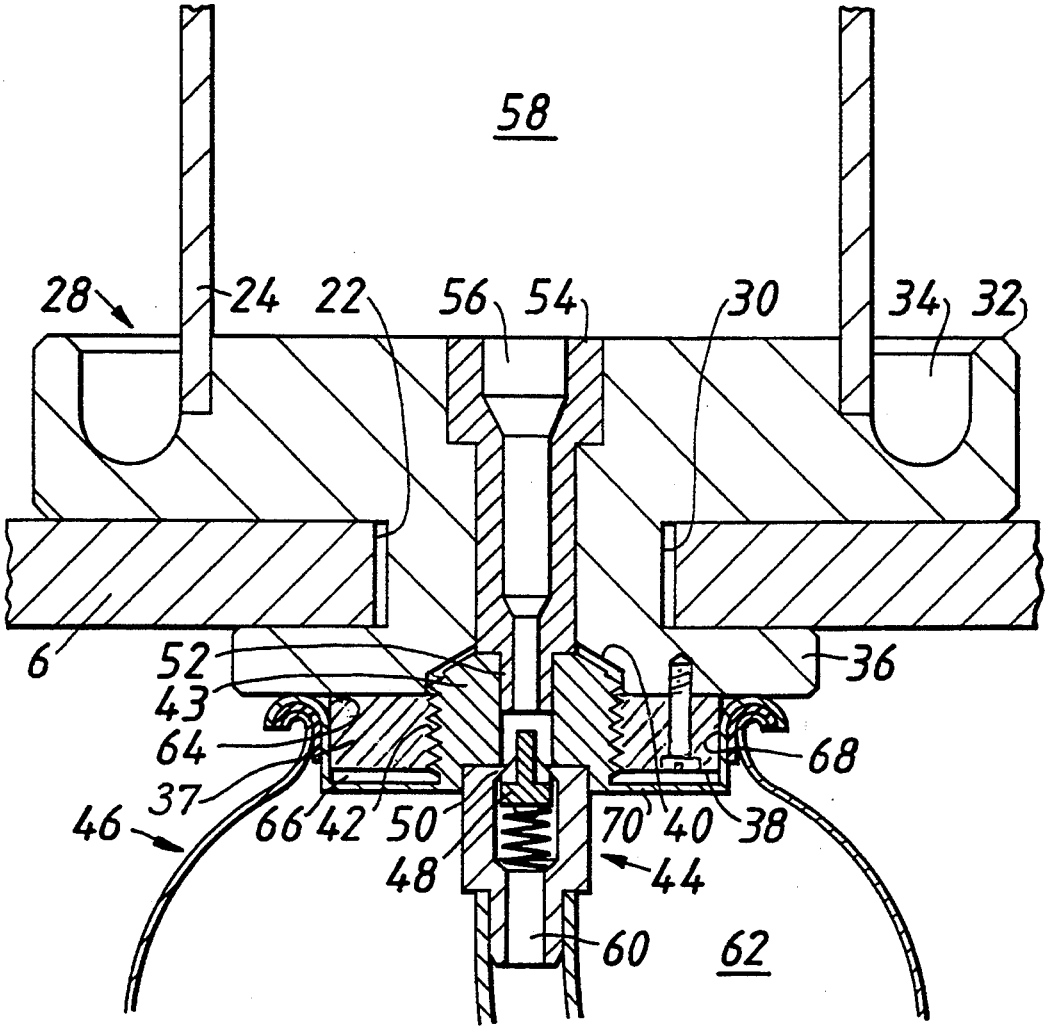
FIG. 3 is an enlarge cross sectional view of a part of the apparatus showing in FIG. 2 showing the engagement of cylinder and aerosol can head.

A valve engaging portion 36 of the cylinder is shown in more detail in FIG. 3.

On the lower surface 38 of bottom portion 36 a central hole 40 is threaded at 42 to engage with an extension 43 of a valve 44 of aerosol dispenser can 46. Below extension 43 is a spring loaded valve member 48 sealing onto a seating 50. Within hole 40 is a cylindrical protrusion 52 of a member 54 screwed into base portion 28. A central conduit 56 communicates from the interior 58 of the cylinder 24 to the valve duct 60 of the can 46 and thence to the interior 62 of the can. The bottom portion 36 has a cylindrical surface 64 which fits snugly into a recess 66 of the cans 46. The recess 66 is defined by a cylindrical inner wall 68 and a base 70.

Due to the engaging arrangements between the base of the cylinder and the can it is not necessary to support the can base 76 on base plate 8 but a suitable jacking device could be provided if hole 40 is unthreaded (see FIG. 2).

Interlock switches 78 and 80 can be provided in the actuator motor circuit to prevent operation of the motor of the door if the cabinet is not closed or if the cylinder 24 is not fully home in its slot 22.

In order to operate the apparatus, a cylinder 24 is screwed to an aerosol can 46 and paint or whatever other liquid is required is poured into the open end of the cylinder. The cylinder with can may be weighed before and after filling to ensure the correct quantity in the cylinder. This allows formulations to be weighed directly into the cylinder. The cylinder with can is then placed in slot 22 and the cabinet door closed. The actuator is then turned on and the piston 20 descends into the cylinder to force the liquid from the cylinder to the can through valve 44 into can 46. At the bottom of its stroke an indicator signal indicates the completion of the cycle and a suitable switch stops the actuator and reverses the piston direction to raise the piston clear of the cylinder.

In FIG. 2 bottom portion 36 has an unthreaded hole 40 in which case part 36 or an extension thereof at 37 is formed a suitable plastics material so that it can be plugged into sealing engagement with inner wall 68 of recess 66 of can 46 and/or valve extension 43 (see detail in FIG. 3). In this case as previously indicated a jack or suitably spaced bottom bearing surface is required on plate 8 for abutting on can base 76. That is to say the distance between plates 6 and 8 is such that can 46 as plugged into the bottom of the cylinder 24 fits snugly into the space between plates 6 and 8.

Bottom portion 36 may have a replaceable extension surrounding hole 40 which may be of brass when threaded or plastics material when unthreaded.

After a batch of cans has been filled or a different color is to be used all parts are thoroughly cleaned.

Now that the preferred embodiments of the present invention have been shown and described in detail, various modifications and improvements thereon will become readily apparent to those skilled in the art. Accordingly, the spirit and scope of the present invention are to be limited only by the appended claims, and not by the foregoing disclosure.

I claim:

1. An aerosol dispenser filling apparatus comprising a cylinder (24) having a lower aerosol can valve engaging portion (36) for engaging an aerosol can around a periphery of the can's valve extension, the cylinder being removably mounted to a part (6) of the apparatus above an aerosol can receiving position, a piston (20) mounted in the apparatus, and means (16) to actuate the piston for movement with the cylinder to force liquid within the cylinder through a valve (44) of an aerosol (46) mounted to the valve engaging portion, wherein the piston is mounted for movement from a position outside and above the cylinder when mounted in the apparatus, and wherein the cylinder has an upper open mouth (26) having an inner surface opening outwardly to provide an upper extremity of greater diameter than that of the piston so as to provide a gradually decreasing entry for the piston into the cylinder and to guide the piston into the cylinder, wherein the aerosol can valve engaging portion has a cylindrical protrusion (52) within a hole (40) in the engaging portion for engaging an interior of the valve extension of the nozzle of the aerosol can without opening the aerosol can valve, the protrusion having a central conduit (56) for communicating from the interior (58) of the cylinder to a valve duct (60) of the aerosol can fitted into the apparatus such that when the piston is moved downwardly, the aerosol can valve will be opened by increased pressure from the liquid due to the piston, wherein the aerosol can valve engaging portion (36) comprises means for attaching the cylinder to an exterior periphery of the valve extension of the nozzle of the aerosol can, the means for attaching together with the cylindrical protrusion (52) defining an annular recess for receiving the valve extension of the nozzle.

2. An apparatus as claimed in claim 1 wherein a jacking device is provided on a base (8) of the apparatus for adjustably seating aerosol cans in the apparatus.

3. An apparatus as claimed in claim 1 wherein the cylinder has a recessed portion (30) at its lower end (28) to engage with a recess (22) in a central part (6) of the apparatus.

4. An apparatus as claimed in claim 3 wherein the cylinder has a circumferential extension (32) above the recessed portion (30), the extension having an annular upwardly facing drip trough (34).

5. An apparatus as claimed in claim 1, wherein the means for attaching has an annular shape and further comprises one of:

a rectangular cross section for press-fitting into an annular recess defined in the can by the can's valve extension, and an inner wall of a top portion of the can; and internal threading (42) for engaging around a periphery of the aerosol can valve.

6. An aerosol dispenser filling apparatus comprising a cylinder (24) having a lower aerosol can valve engaging portion (36) for engaging an aerosol can around a periphery of the can's valve extension, the cylinder being removably mounted to a part (6) of the apparatus above an aerosol can receiving position, a piston (20) mounted in the apparatus, and means (16) to actuate the piston for movement within the cylinder to force liquid within the cylinder through a valve (44) of an aerosol can (46) mounted to the valve engaging portion, wherein the piston is mounted for movement from a position outside and above the cylinder when mounted in the apparatus, and wherein the cylinder has an upper open mouth (26) having an inner surface opening outwardly to provide an upper extremity of greater diameter than that of the piston so as to provide a gradually decreasing entry for the piston into the cylinder and to guide the piston into the cylinder, wherein the aerosol can valve engaging portion has a cylindrical protrusion (52) within a hole (40) in the engaging portion for engaging an interior of the valve extension of the nozzle of the aerosol can, the protrusion having a central conduit (56) for communicating from the interior (58) of the cylinder to a valve duct (60) of the aerosol can fitted into the apparatus, wherein the means (16) to actuate the piston comprises a power-driven actuator having an interlock switch (78) so arranged as to detect if the cylinder is fully home in the apparatus and to prevent actuation of the piston in the event of the cylinder not being fully home.

* * * * *

UNITED STATES PATENT AND TRADEMARK OFFICE

CERTIFICATE OF CORRECTION

PATENT NO. : 5,377,724

DATED : January 3, 1995

INVENTOR(S) : George F. Ray

It is certified that error appears in the above-indentified patent and that said Letters Patent is hereby corrected as shown below:

Column 3, line 61, change "with" to -- within --.

Column 3, line 62, after "aerosol" insert -- can --.

Signed and Sealed this

Fifth Day of September, 1995

*Attest:*

*Attesting Officer*

BRUCE LEHMAN

*Commissioner of Patents and Trademarks*